US010220979B2

(12) United States Patent
Silkaitis

(10) Patent No.: US 10,220,979 B2
(45) Date of Patent: Mar. 5, 2019

(54) CONTAINER FOR RUBBER OR SURGICAL GLOVES WITH MAGNETIC MOUNTING DEVICE

(71) Applicant: Medline Industries, Inc., Mundelein, IL (US)

(72) Inventor: Thomas Silkaitis, Lake Zurich, IL (US)

(73) Assignee: Medline Industries, Inc., Northfield, IL (US)

( * ) Notice: Subject to any disclaimer, the term of this patent is extended or adjusted under 35 U.S.C. 154(b) by 0 days.

(21) Appl. No.: 15/199,014

(22) Filed: Jun. 30, 2016

(65) Prior Publication Data

US 2016/0311577 A1 Oct. 27, 2016

Related U.S. Application Data

(63) Continuation of application No. 14/301,062, filed on Jun. 10, 2014.

(60) Provisional application No. 61/993,951, filed on May 15, 2014.

(51) Int. Cl.

| | |
|---|---|
| ***B65D 85/18*** | (2006.01) |
| ***B65D 25/22*** | (2006.01) |
| ***B65D 75/54*** | (2006.01) |
| ***B65D 5/42*** | (2006.01) |
| ***B65D 83/08*** | (2006.01) |

(52) U.S. Cl.

CPC ..... *B65D 25/22* (2013.01); *B65D 5/4208* (2013.01); *B65D 75/54* (2013.01); *B65D 83/0805* (2013.01); *B65D 85/18* (2013.01); *B65D 2313/04* (2013.01)

(58) Field of Classification Search

CPC ..... B65D 25/22; B65D 85/16; B65D 85/18

USPC ..... 206/278, 335, 818

See application file for complete search history.

(56) References Cited

U.S. PATENT DOCUMENTS

| | | | | |
|---|---|---|---|---|
| 3,243,079 A | | 3/1966 | Rettmer | |
| 3,369,709 A | | 2/1968 | Clauss | |
| 3,642,122 A | | 2/1972 | Von Ende | |
| 4,997,105 A | | 3/1991 | Fischer | |
| 5,000,417 A | * | 3/1991 | Yamada | A47F 5/08 248/206.5 |
| 5,533,621 A | * | 7/1996 | Schoal, Jr. | A47K 10/3827 206/409 |
| 5,598,923 A | * | 2/1997 | Owens | A61B 50/312 150/130 |
| 5,816,440 A | | 10/1998 | Shields et al. | |

(Continued)

OTHER PUBLICATIONS

Collado, Cynthia F. , "NonFInal OA", U.S. Appl. No. 14/301,062, filed Jun. 10, 2014; dated Aug. 21, 2017.

(Continued)

*Primary Examiner* — Sue A Weaver

(74) *Attorney, Agent, or Firm* — Philip H. Burrus, IV

(57) ABSTRACT

A container (100) includes a first side (101) defining an aperture (107), a second side (102), and a plurality of other sides (103,104,105). The first side, the second side, the plurality of other sides defining an interior volume (106) of the container. A plurality of gloves (110) is disposed within the interior volume such that one or more gloves may be drawn from the container through the aperture. A magnetic device (112) is proximately located with the second side. When the second side is proximately located with a ferrous object, the magnetic device magnetically couples the container to the ferrous object.

18 Claims, 6 Drawing Sheets

(56) References Cited

U.S. PATENT DOCUMENTS

| | | | | |
|---|---|---|---|---|
| 6,006,906 | A * | 12/1999 | Winnard | B25H 3/06 206/350 |
| 6,095,326 | A | 8/2000 | Madhat et al. | |
| 8,061,558 | B2 * | 11/2011 | Jordan | B65D 83/0894 221/196 |
| 8,132,692 | B2 * | 3/2012 | Jordan | B65D 83/0805 221/196 |
| 8,210,393 | B1 * | 7/2012 | Nasrallah | A47K 10/423 221/38 |
| 8,646,653 | B2 * | 2/2014 | Lien | B65D 83/0805 206/494 |
| D809,318 | S | 2/2018 | Hammons et al. | |
| 2004/0099623 | A1 | 5/2004 | Kurtz | |
| 2004/0245269 | A1 | 12/2004 | Grinberg | |
| 2005/0056655 | A1 * | 3/2005 | Gary | A47G 19/2261 220/737 |
| 2007/0131695 | A1 | 6/2007 | Hsing-Hsien | |
| 2008/0314920 | A1 | 12/2008 | Rodrigues | |
| 2009/0261001 | A1 | 10/2009 | Yao et al. | |
| 2010/0276333 | A1 | 11/2010 | Couture | |
| 2012/0298689 | A1 | 11/2012 | Cohen | |
| 2013/0186787 | A1 | 7/2013 | Yao et al. | |
| 2016/0152403 | A1 | 6/2016 | Ray | |

OTHER PUBLICATIONS

Collado, Cynthia F. , "NonFinal OA", U.S. Appl. No. 14/301,062, filed Jun. 10, 2014; dated Feb. 9, 2017.

Collado, Cynthia F. , "Notice of Allowance", U.S. Appl. No. 14/301,062, filed Jun. 10, 2014; dated Jun. 4, 2018.

Collado, Cynthia "NonFinal OA", U.S. Appl. No. 14/301,062, filed Jun. 10, 2014; dated Dec. 3, 2015.

Collado, Cynthia F., "Final OA", U.S. Appl. No. 14/301,062, filed Jun. 10, 2014; dated May 3, 2016.

Collado, Cynthia Francisca "Notice of Allowance", U.S. Appl. No. 14/301,062, filed Jun. 10, 2014; dated Nov. 15, 2016.

"Medline Catalog", *Clear PETG Glove Box Holder by Omnimed*; Medline Catalog; http://www.medline.com/catalog/catalog.jsp; Unknown Publication date but believed to be prior to present application filing date.

"Medline Catalog", *Fluorescent Side-Loading Glove Dispenser by MarketLab*; Medline Catalog; http://www.medline.com/catalog/catalog.jsp; Unknown Publication date but believed to be prior to present application filing date.

"Medline Catalog", *Glove Box by Becton Dickinson*; Medline Catalog; http://www.medline.com/catalog/catalog.jsp; Unknown Publication date but believed to be prior to present application filing date.

"Medline Catalog", *Glove Box Dispenser by Unico*; Medline Catalog; http://www.medline.com/catalog/catalog.jsp; Unknown Publication date but believed to be prior to present application filing date.

"Medline Catalog", *Glove Box Dispensers by Alimed*; Medline Catalog; http://www.medline.com/catalog/catalog.jsp; Unknown Publication date but believed to be prior to present application filing date.

"Medline Catalog", *Glove Box Holders by Cardinal Health*; Medline Catalog; http://www.medline.com/catalog/catalog.jsp; Unknown Publication date but believed to be prior to present application filing date.

"Medline Catalog", *Glove Dispensers by Alimed*; Medline Catalog; http://www.medline.com/catalog/catalog.jsp; Unknown Publication date but believed to be prior to present application filing date.

"Medline Catalog", *Glove Dispensers by Halyard Health*; Medline Catalog; http://www.medline.com/catalog/catalog.jsp; Unknown Publication date but believed to be prior to present application filing date.

"Medline Catalog", *Glove Dispensing Box Holders by Graham-Field*; Medline Catalog; http://www.medline.com/catalog/catalog.jsp; Unknown Publication date but believed to be prior to present application filing date.

"Medline Catalog", *Plastic Glove Box Dispenser with Dividers*; Medline Catalog; http://www.medline.com/catalog/catalog.jsp; Unknown Publication date but believed to be prior to present application filing date.

"Medline Catalog", *Plastic Glove Box Holders by Heathrow Scientific*; Medline Catalog; http://www.medline.com/catalog/catalog.jsp; Unknown Publication date but believed to be prior to present application filing date.

"Medline Catalog", *Sharps Cabinets Glove Box Holders*; Medline Catalog; http://www.medline.com/catalog/catalog.jsp; Unknown Publication date but believed to be prior to present application filing date.

"Medline Catalog", *SharpSafety Multi-Glove Box Dispensers by Covidien*; Medline Catalog; http://www.medline.com/catalog/catalog.jsp; Unknown Publication date but believed to be prior to present application filing date.

"Medline Catalog", *Silhouette Glove Dispenser by MarketLab*; Medline Catalog; http://www.medline.com/catalog/catalog.jsp; Unknown Publication date but believed to be prior to present application filing date.

"Medline Catalog", *Single Glove Dispenser with Lid by Marke*; Medline Catalog; http://www.medline.com/catalog/catalog.jsp; Unknown Publication date but believed to be prior to present application filing date.

"Medline Catalog", *SS Glove Dispenser with Epoxy Powder-Coat Finish by MarketLab*; Medline Catalog; http://www.medline.com/catalog/catalog.jsp; Unknown Publication date but believed to be prior to present application filing date.

"Medline Catalog", *Stainless Steel Glove Box Holders*; Medline Catalog; http://www.medline.com/catalog/catalog.jsp; Unknown Publication date but believed to be prior to present application filing date.

"Medline Catalog", *Stainless Steel Glove Dispenser by MarketLab*; Medline Catalog; http://www.medline.com/catalog/catalog.jsp; Unknown Publication date but believed to be prior to present application filing date.

"Medline Catalog", *Vertical Glove Box Dispenser by Terra*; Medline Catalog; http://www.medline.com/catalog/catalog.jsp; Unknown Publication date but believed to be prior to present application filing date.

Collado, Cynthia F., "Final Office Action", U.S. Appl. No. 14/301,062, filed Jun. 10, 2014; dated Feb. 21, 2018.

* cited by examiner

CONTAINER FOR RUBBER OR SURGICAL GLOVES WITH MAGNETIC MOUNTING DEVICE

CROSS REFERENCE TO PRIOR APPLICATIONS

This application claims priority and benefit under 35 U.S.C. § 120 as a continuation application from U.S. Ser. No. 14/301,062, filed Jun. 10, 2014, which claims priority and benefit under 35 U.S.C. § 119(e) from U.S. Provisional Application No. 61/993,951, filed May 15, 2014, each of which is incorporated herein by reference for all purposes.

BACKGROUND

Technical Field

This invention relates generally to containers, and more particularly to containers for gloves.

Background Art

Gloves are used to protect the hands of a user. In many industries, such as medical and surgical industries, the use of gloves is not only a protective measure, but is a requirement. Medical services personnel, for example, are required to wear disposable gloves to prevent contact with bodily fluids during surgical procedures, medical examinations, laboratory testing and other medical procedures. Disposable gloves have traditionally been made of rubber materials such as latex, thermoplastic materials such as vinyl, and other natural and synthetic materials.

Many gloves are provided in packaging where one or more gloves are disposed in an interior of a package. Such packaging frequently includes an opening through which a user may draw one or more gloves.

Figure 1:
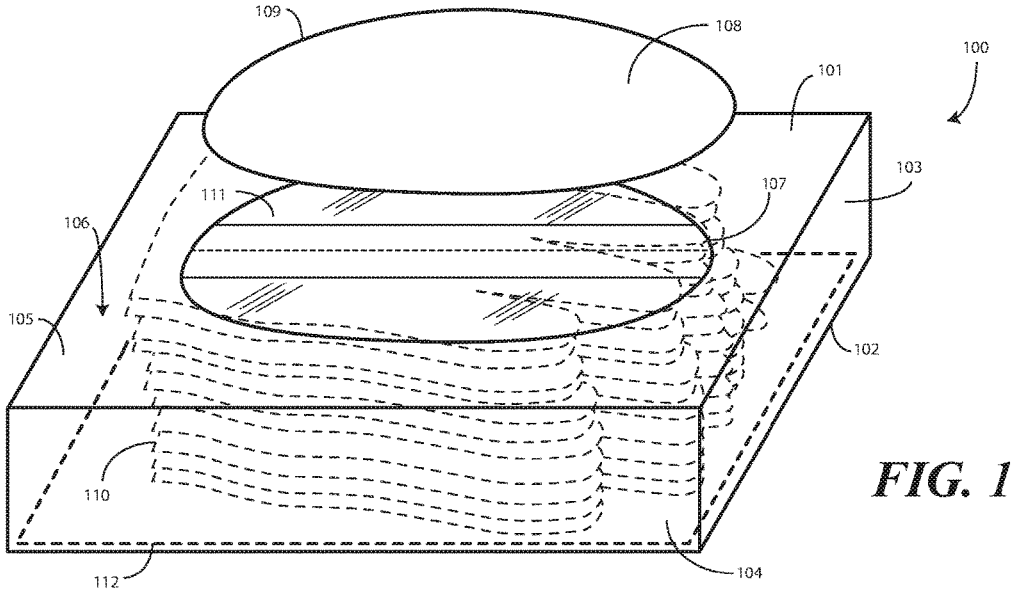
FIG. 1 illustrates one explanatory container in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF EMBODIMENTS OF THE INVENTION

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. It is expected that one of ordinary skill, notwithstanding possibly significant effort and many design choices motivated by, for example, available time, current technology, and economic considerations, when guided by the concepts and principles disclosed herein will be readily capable of generating embodiments configured in accordance with the disclosure. Also, reference designators shown herein in parenthesis indicate components shown in a figure other than the one in discussion. For example, talking about a device (10) while discussing figure A would refer to an element, 10, shown in figure other than figure A.

Prior art containers for gloves are traditionally manufactured from cardboard. Accordingly, when placed on a slick surface such as a steel table in an operating room, the container tends to slide around when a user attempts to draw a glove through the opening. Additionally, the container occupies precious real estate on horizontal surfaces when those surfaces may be in short supply in an operating room environment.

Advantageously, embodiments of the disclosure provide a container that neither slides nor requires space on a horizontal surface. In one embodiment, a container having one or more gloves disposed within an interior volume also includes a magnetic device proximately located with one side of the container. The inclusion of a magnetic device allows the container to "stick" to any ferrous object, including metal cabinets, walls, or other surfaces. Accordingly, a user may simply "slap" the container against a vertical metal surface to conveniently stow the container where it is conveniently accessible, but not located on a horizontal surface.

A second advantage of embodiments of the disclosure is that they facilitate single-handed drawing of one or more gloves from the container. As prior art containers slide all over the place when a user attempts to retrieve a glove due to the compression forces of the gloves in the container, a user must use two hands to retrieve a glove. A first hand is used to hold the container, while the second hand draws the glove from the container. With embodiments of the present disclosure, the magnetic device proximately located with one of the sides is strong enough to hold the container to a vertical surface while a user draws a glove from the container. Experimental testing has shown that drawing the first glove from the container frequently requires more force than does drawing the last glove due to the compression forces of the gloves within the container. Advantageously, in one or more embodiments, the magnetic device can be configured with a magnetic force that is greater than a force coefficient associated with drawing a first glove of a plurality of gloves from the container. The magnetic force can be greater than this force coefficient and the weight of the container in one or more embodiments.

Turning now to FIG. 1, illustrated therein is one explanatory container 100 configured in accordance with one or more embodiments of the disclosure. The container 100 may be manufactured from any of a variety of materials or combinations of materials, including paper, cardboard, plastic, metal, or fabric. In the illustrative embodiment of FIG. 1, the container 100 is manufactured from single-ply cardboard. Where the container 100 is manufactured from plastic, the plastic may be a thermoform plastic or other rigid plastic and may be transparent, semi-transparent or non-transparent. Regardless of whether cardboard, metal, plastic, or fabric, the container 100 may be of any desired color. Other materials will be obvious to those of ordinary skill in the art having the benefit of this disclosure. The container 100 may have letters, pictures, logos, designs, instructions for using the contents therein, and/or other markings placed thereon through printing, engraving, molding, or any other suitable method.

The container 100 includes a first side 101, a second side 102, and a plurality of other sides 103,104,105. In one embodiment, the first side 101 defines a first major face of the container 100, while the second side 102 defines a second major face of the container 100. The plurality of other sides 103,104,105 define minor faces of the container 100 that are disposed between the first major face 101 and the second major face 102 of this embodiment, thereby giving the container 100 a rectangular appearance. It will be obvious to those of ordinary skill in the art having the benefit of this disclosure that the container 100 can be configured in other shapes as well, including cubes, cylinders, pyramids, and other shapes.

In this illustrative embodiment, the first side 101 is disposed opposite the plurality of other sides 103,104,105 from the second side 102. Said differently, in this embodiment, the first side 101 is the top of the container, the second side 102 is the bottom of the container, and the plurality of other sides 103,104,105 are disposed between the top and the bottom.

In one embodiment, one of the sides defines an aperture 107. In this illustrative embodiment, the first side 101 defines the aperture 107. In other embodiments, the aperture 107 can be disposed on the second side 102. In still other embodiments, the aperture 107 can be disposed on one of the plurality of other sides 103,104,105. In still other embodiments, multiple apertures can be disposed on multiple sides.

In one embodiment, the aperture 107 allows one or more gloves to be drawn through the aperture 107 from the container 100. Said differently, a user can remove one or more of the gloves from the container by drawing them through the aperture 107. The aperture 107 may be configured in the form of different shapes, such as a circle, an oval, a square, a rectangle, or any variation of such shapes, such that a user may insert his or her fingers or a portion of the hand through the aperture 107 to remove one or more of the gloves.

In one embodiment, the aperture 107 may initially be covered by a removable segment 108 that is initially formed as part of the container 100. The removable segment 108, in one embodiment, is separable from the container 100 by a perforation 109 or a perforated segment. Once the container is ready for use by a user, in one embodiment the user may tear the removable segment 108 away from the container 100 along the perforation 109 or perforated segment. The removable segment 108 is generally discarded after it is removed from the container 100. In addition to a perforated segment, the removable segment 108 may include an adhesive segment that is removable from the container 100 as well.

In this illustrative embodiment, the first side 101, the second side 102, the plurality of other sides 103,104,105 define an interior volume 106 of the container 100. A plurality of gloves 110 is disposed within the interior volume 106 such that one or more gloves may be drawn from the container 100 through the aperture 107. In one embodiment, both the interior volume 106 and the plurality of gloves 110 are configured to be sterile such that they are immediately ready for use in medical procedures without additional cleaning or sterilization.

The plurality of gloves 110 may comprise medical and/or surgical gloves that are optionally disposable in one or more embodiments. Alternatively, the plurality of gloves 110 may be other types of gloves, e.g., non-medical or non-surgical gloves. Other types of gloves suitable for use with containers configured in accordance with one or more concepts described herein will be obvious to those of ordinary skill in the art having the benefit of this disclosure. The plurality of gloves 110 may be non-transparent, transparent or semi-transparent. Further, the plurality of gloves 110 may have any desired color. Each glove of the plurality of gloves 110 can be a fingered glove with defined fingers, or alternatively a mitten style glove with one compartment for the fingers and another for the thumb. The plurality of gloves 110 may all be of the same size, or alternatively may have different sizes. Different sizes may be placed into a single container 100, or different sizes may be placed in different containers. The size of the container 100 can vary based upon the size of the gloves disposed therein.

In one embodiment, the plurality of gloves 110 is manufactured from rubber materials such as latex. In other embodiments, the plurality of gloves 110 is manufactured from thermoplastic materials such as vinyl. In still other embodiments, the plurality of gloves 110 is manufactured from and other natural and synthetic materials, such as nitrile, polyvinyl chloride, polyethylene, polyisoprene, neoprene, polychloriprene, etc. Other materials suitable for the manufacture of the plurality of gloves 110 will be obvious to those of ordinary skill in the art having the benefit of this disclosure.

Figure 15:
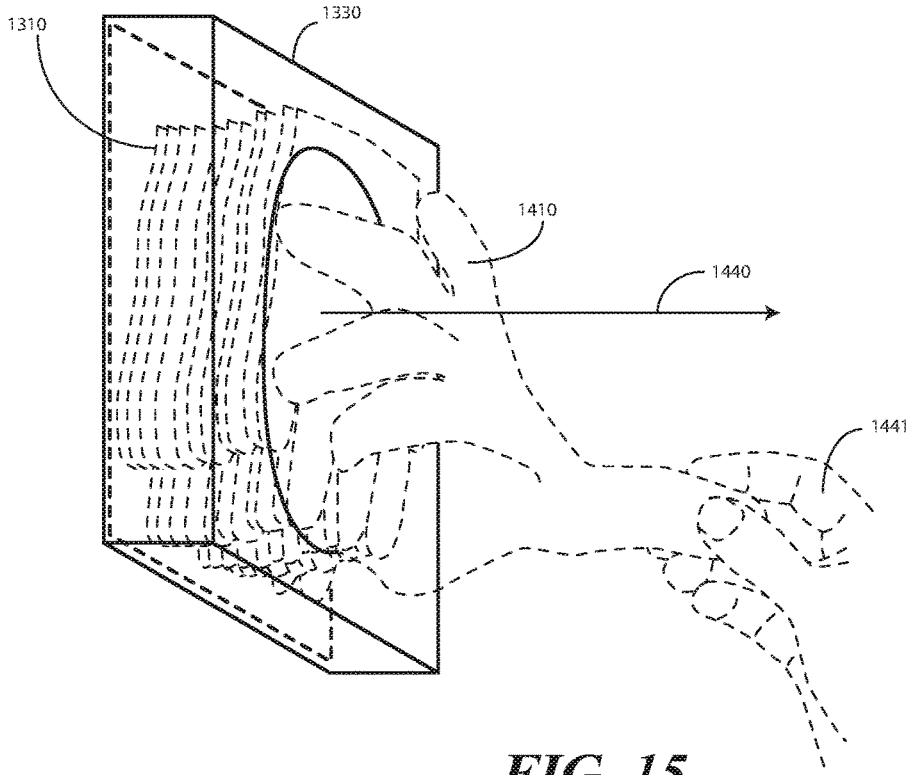
FIG. 15 one explanatory container in accordance with one or more embodiments of the disclosure in use.

The plurality of gloves 110 may be stacked in a uniform direction, for example, with all the finger portions pointing in the same direction. The plurality of gloves 110 may also be arranged in an alternating fashion, with each subsequent glove being rotated 60, 90, or 180 degrees out of phase with the preceding glove. In another embodiment, the plurality of gloves 110 may be randomly disposed within the container 100. As will be described below with reference to FIGS. 15-16, force coefficients to remove one or more of the plurality of gloves 110 from the container 100 may be associated with each arrangement. In one embodiment, the force coefficient associated with the random disposition of the plurality of gloves 110 in the container 100 will have the highest force coefficient.

In one or more embodiments, each glove of the plurality of gloves 110 may comprise or include other materials, such as antimicrobial coatings and/or coatings for protecting the skin that include aloe, chamomile, vitamin(s), or combinations thereof In other embodiments, each glove of the plurality of gloves 110 may comprise other suitable ingredients that may provide skin care benefits, such as moisturizing and soothing dry, irritated skin. Other glove additives will be obvious to those of ordinary skill in the art having the benefit of this disclosure.

In one embodiment, the container 100 may comprise a barrier 111 that spans and/or covers at least a portion of the aperture 107. The barrier 111 may be a film, a piece of paper laminated with film or any type of flexible material that is suitable for providing or acting as a barrier. In one or more embodiments, the barrier 111 inhibits or prevents microorganisms, pathogens, small airborne particles of dust and debris and other air contaminants from contacting and thus contaminating the plurality of gloves 110 prior to removal from the container 100.

In one or more embodiments, the barrier 111 helps to protect the plurality of gloves 110 from being exposed to undesirable materials or contaminants while the plurality of gloves 110 is disposed within the container 100 beneath the barrier. Advantageously, providing a plurality of gloves 110 that is free from undesirable materials or contaminants reduces the risk, when those gloves are used for healthcare procedures, that patients and healthcare workers will be exposed to such materials or contaminants. Where the plurality of gloves 110 and the interior volume 106 are sterile, this configuration further reduces the opportunity to spread potentially harmful and infectious materials or contaminants. Furthermore, providing a plurality of gloves 110 that are free from undesirable materials or contaminants also reduces or prevents cross-contamination that may occur between different patients.

A second advantage of including the optional barrier 111 is that it provides an indicator of tampering for a user. In addition to providing a more sanitary dispensing package, the barrier 111 provides a temper-proof covering over the aperture 107. Any attempt to disturb the barrier 111 is likely to be clearly visible to a user. The user therefore would be alerted to any tampering.

In one embodiment, the barrier 111 is manufactured from a film. The film can be any of a variety of materials, including polypropylene, polystyrene, polyester, polyamide, polyvinylchloride, polyethylene (low density polyethylene, medium density polyethylene and/or high density polyethylene), polyvinylidene chloride, regenerated cellulose, cellulose acetate, and/or combinations thereof. The film material selected may be based on factors such as cost, shelf life, barrier effectiveness, performance, etc. The film, including the paper-laminated film and any of the embodiments described herein, may have a thickness of less than about 10 mils, particularly from about 1 mil to about 6 mils. The thickness may be selected based on a variety of factors such as barrier effectiveness, cost, material(s) used, performance characteristics such as transparency and flexibility, etc. The film may be clear or colored. The film may also be printed or plain, and may be flat, patterned or embossed. Also, the film may be laminated with one or more other materials, in addition to paper, such as foil, vinyl or other materials. The film, including the paper-laminated film and any of the embodiments described herein, helps to prevent exposure of the inside of the container 100 to microorganisms, airborne particles and other materials or contaminants.

The barrier 111 may be a single sheet of film or may be multi-layered. Where laminated, the layers of the barrier 111 may comprise the same type of or different materials. The barrier 111 may also cover all or a portion of the first side 101 of the container 100, and may include an opening, aperture or slit in the middle of the barrier 11 for removing the gloves from the container. In one or more embodiments, providing additional materials and/or additional layers may provide better protection than a single layer. In one or more embodiments, the barrier includes an antimicrobial material as described in commonly assigned, co-pending U.S. application Ser. No. 13/790,091, filed Mar. 8, 2013, which is incorporated herein by reference for all purposes.

In the illustrative embodiment of FIG. 1, a magnetic device 112 is proximately located with one of the sides of the container 100. In this embodiment, the magnetic device 112 is proximately located with the second side 102 of the container 100. In one embodiment, the magnetic device 112 is a singular planar magnet that substantially spans the second side 102 of the container 100. As will be shown in FIGS. 5-12 below, in other embodiments the magnetic device 112 takes different shapes and quantities.

In one embodiment, the magnetic device 112 is manufactured from a magnetically hard material. In another embodiment, the magnetic device 112 is manufactured from a magnetically flexible material. In one embodiment, the magnetic device 112 is able to retain its magnetism permanently after magnetization. For example, the magnetic device 112 can be manufactured from a material such as AlNiCo, which is a mixture that includes aluminum, nickel, cobalt and steel. In other embodiments, the magnetic device 112 can be manufactured from ceramic materials or rare earth metals. In yet another embodiment, the magnetic device 112 is manufactured from a material having a large magnetic force, such as from neodymium-iron-boron.

In one embodiment, the magnetic device 112 is to couple the container 100 to a ferrous object when the second side 102 (or whichever side the magnetic device 112 is proximately disposed) is proximately located with the ferrous object. Examples of ferrous objects include objects manufactured from iron, low carbon and low silicon steel, or other materials having a high magnetic permeability. Accordingly, the container 100 can be mounted to a ferrous object, such as a vertical filing cabinet door, metal door, or other object, by simply placing the second side 102 adjacent to the object. The magnetic device 112 thus becomes a "horizontal surface occupier buster" in that the container 100 can be mounted on vertical surfaces via the magnetic device 112 rather than occupying precious horizontal surface space which may be in limited supply.

Figure 2:
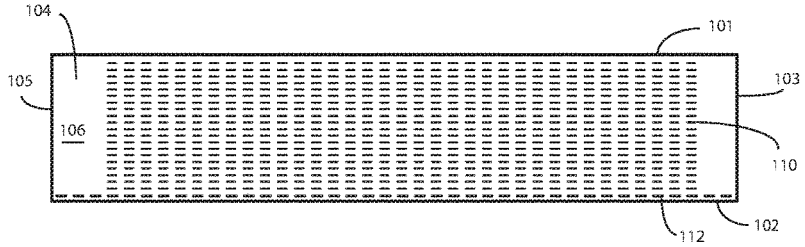
FIG. 2 illustrates a side elevation sectional view of one explanatory container in accordance with one or more embodiments of the disclosure.

Turning now to FIG. 2, illustrated therein is a side elevation sectional view of the container 100 showing the first side 101, the second side 102, and the plurality of other sides 103,104,105. The plurality of gloves 110 is disposed within the interior volume 106 of the container 100 as well.

Figure 3:
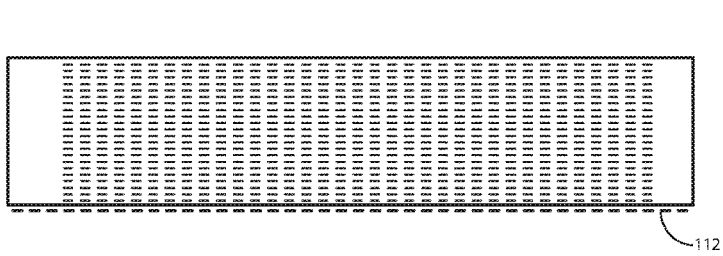
FIG. 3 illustrates a side elevation sectional view of another explanatory container in accordance with one or more embodiments of the disclosure.

In this illustrative embodiment, the magnetic device 112 is disposed within the interior volume 106 of the container 100 and adjacent to interior face of the second side 102 of the container 100. For example, in one embodiment, the magnetic device 112 is adhesively coupled to the interior face of the second side 102 of the container 100. It should be noted, however, that this is but one suitable position for the magnetic device 112. For example, turning now to FIG. 3, the magnetic device 112 is disposed exterior to the container 100, such as by adhesive coupling.

Figure 4:
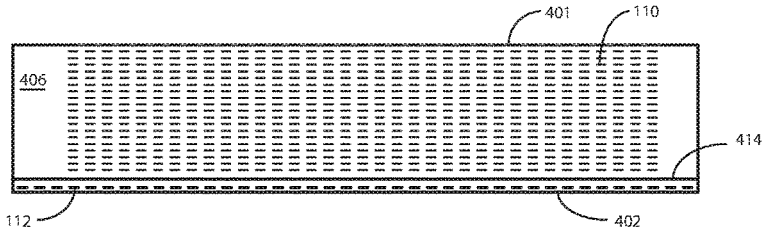
FIG. 4 illustrates a side elevation sectional view of another explanatory container in accordance with one or more embodiments of the disclosure.

Turning now to FIG. 4, the container 400 of this embodiment includes a partition 414. The partition 414 of this illustrative embodiment is provides to separate the plurality of gloves 110 from the magnetic device 112. This configuration can be advantageously used, for example, when the interior volume 406 of the container 400 and/or the plurality of gloves 110 is sterile, but the magnetic device 112 is non-sterile. In this embodiment, the magnetic device 112 is disposed between the second side 402 of the container 400 and the partition 401, while the plurality of gloves 110 is disposed between the first side 401 of the container 400 and the partition 414. Locations of the magnetic device 112 other than those shown in FIGS. 2-4 will be obvious to those of ordinary skill in the art having the benefit of this disclosure.

Figure 5:
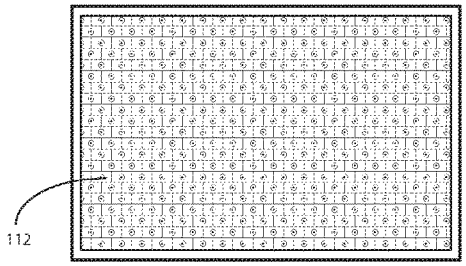
FIG. 5 illustrates a plan sectional view of one explanatory container in accordance with one or more embodiments of the disclosure.

Turning now to FIGS. 5-12, illustrated therein are various configurations for the magnetic device (112) itself Beginning with FIG. 5, the magnetic device 112 is configured as a single, unitary, and contiguous sheet. This is the configuration shown in FIG. 1 as well.

Figure 6:
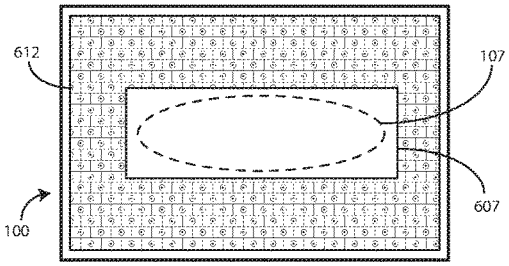
FIG. 6 illustrates a plan sectional view of another explanatory container in accordance with one or more embodiments of the disclosure.

In FIG. 6, the magnetic device 612 is a single sheet that defines another aperture 607. For ease of illustration, the aperture 107 through which one or more gloves may be drawn from a container 100 is also shown. In this illustrative embodiment, the area defined by aperture 607 is greater than the area defined by aperture 107. Said differently, aperture 607 spans more area than does aperture 107. This configuration can be advantageous in distributing the magnetic forces coupling the container 100 to a ferrous object uniformly about the aperture 107 through which the one or more gloves are drawn to promote stability of adhesion for the container. The aperture 607 could be configured oppositely in other embodiments, with aperture 607 spanning less area than aperture 107.

In this embodiment, aperture 607 is axially aligned with aperture 107. As shown, the aperture 607 would be axially aligned with the first major face (101) and the second major face (102) of the container 100 as well. However, in other embodiments, the aperture 607 may be non-axially aligned with aperture 107. For example, if the folding method for the plurality of gloves (110) is such that compression forces are greater on the left side of the container 600 than the right, aperture 607 may be translated so that it is not axially aligned with aperture 107, but instead is right side biased. Accordingly, in one or more embodiments, aperture 607 may be biased to one of the left, right, top, or bottom of aperture 107.

Figure 7:
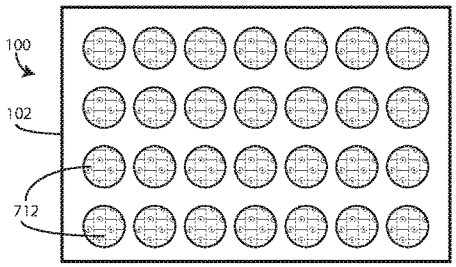
FIG. 7 illustrates a plan sectional view of another explanatory container in accordance with one or more embodiments of the disclosure.
Figure 8:
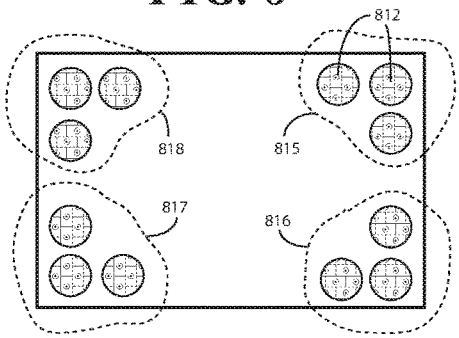
FIG. 8 illustrates a plan sectional view of another explanatory container in accordance with one or more embodiments of the disclosure.

In FIG. 7, the magnetic device 712 comprises an array of magnetic devices. In this embodiment, the array of magnetic devices is uniformly distributed across the second major face 102 of the container 100. By contrast, in FIG. 8, the magnetic device 812 comprises an array of magnetic devices that is non-uniformly distributed. In FIG. 8, the array of magnetic devices comprises at least four clusters 815,816, 817,818 of magnetic devices, with at least one cluster of magnetic devices disposed in each corner of the container.

Figure 9:
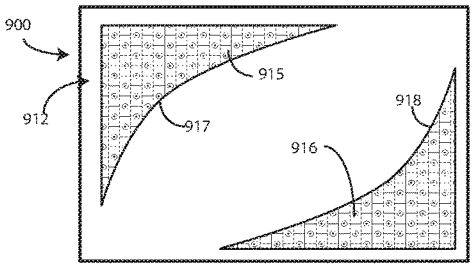
FIG. 9 illustrates a plan sectional view of another explanatory container in accordance with one or more embodiments of the disclosure.

In FIG. 9, the magnetic device 912 comprises two magnetic devices, each having a free-form shape. These magnetic devices have been placed in opposite corners, with magnetic device 915 being a 180-degree rotation of magnetic device 916. As with the magnetic device (612) of FIG. 6, the magnetic device 912 of FIG. 9 can be shaped to accommodate a particular glove folding method or manufacturing process. If, for example, the folding method for gloves results in higher compression forces residing in the upper left-hand corner and the lower right-hand corner of the container 900, with that compression force diminishing in accordance with a predefined gradient moving toward the lower left-hand corner and the upper right-hand corner, respectively, placing magnetic device 915, with its gradient shaped side 917, in the upper left-hand corner and magnetic device 916, with its gradient shaped side 918, in the lower right-hand corner can provide the proper stabilization for the container 900 when gloves are drawn therefrom. It should be noted that magnetic devices configured in accordance with embodiments of the disclosure can be formed in different shapes, such as a circle, an oval, a square, a rectangle, or any variation of such shapes.

Figure 10:
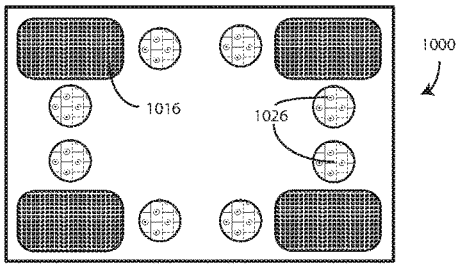
FIG. 10 illustrates a plan sectional view of another explanatory container in accordance with one or more embodiments of the disclosure.

In FIG. 10, two types of magnetic devices 1016, 1026 have been used. Magnetic device 1016 as a higher magnetic force than does magnetic device 1026 in this illustrative embodiment. The arrangement of the magnetic devices 1016, 1026 in this embodiment is a function of the glove manufacturing and folding process, and has resulted in the stronger magnetic devices 1016 being placed in the corners of the container 1000, while the weaker magnetic devices 1026 are placed in other locations to offset compression and/or drag forces along the inside of the container 1000 when gloves are drawn therefrom.

Figure 11:
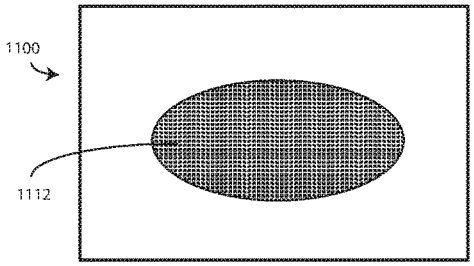
FIG. 11 illustrates a plan sectional view of another explanatory container in accordance with one or more embodiments of the disclosure.

In FIG. 11, the magnetic device 1112 is axially aligned with each of the first major face, the second major face, and the aperture of this particular container 1100. The magnetic device 1112 is an expanded shape of the aperture, i.e., an oval but a larger oval than the aperture, and is placed directly beneath the aperture so as to oppose forces from users drawing gloves from the aperture. The magnetic device 1112 of this embodiment completely spans the aperture. In other embodiments, the magnetic device may only partially span the aperture.

Figure 12:
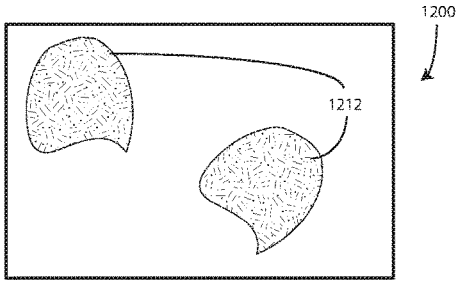
FIG. 12 illustrates a plan sectional view of another explanatory container in accordance with one or more embodiments of the disclosure.

In FIG. 12, the magnetic devices 1212 have freeform shapes and are randomly placed within the container 1200. In some applications, the magnetic forces associated with the magnetic devices will be sufficiently strong as to retain the container 1200 against a vertical surface regardless of how much force is required to draw gloves from the container. Accordingly, in such applications, cost can be saved by using magnetic devices 1212 having irregular or freeform shapes that are randomly disposed within the container 1200.

The shapes, configurations, and applications of FIGS. 5-12 are merely illustrations of the wide variety of ways in which embodiments of the disclosure can be arranged. Others will be readily apparent to those of ordinary skill in the art having the benefit of this disclosure. The benefits, advantages, solutions to problems, and any element(s) that may cause any benefit, advantage, or solution to occur or become more pronounced are not to be construed as a critical, required, or essential features or elements of any or all the claims.

Figure 13:
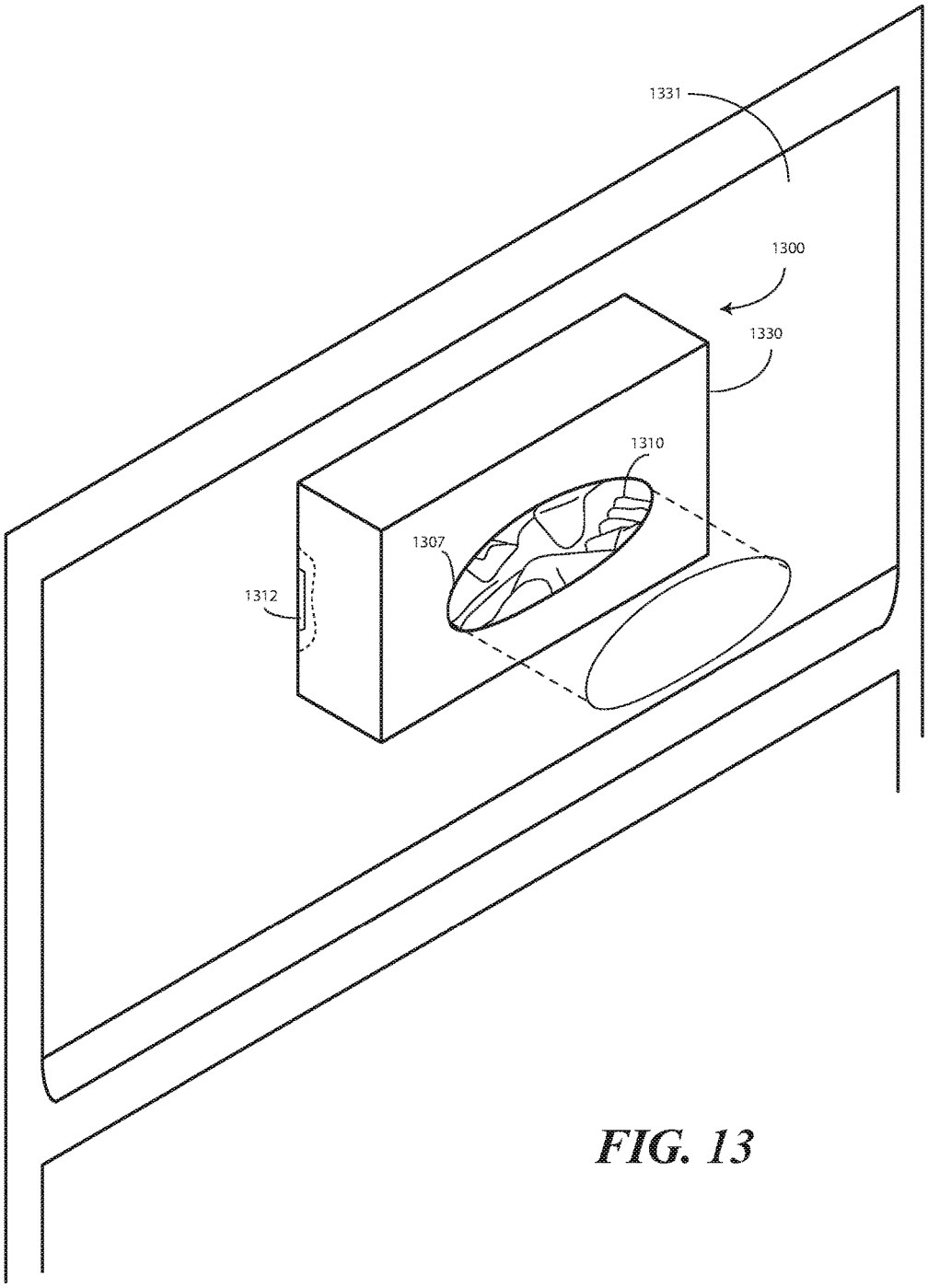
FIG. 13 illustrates one explanatory container in accordance with one or more embodiments of the disclosure in use.

Turning now to FIG. 13, illustrated therein is an apparatus 1300 for dispensing gloves 1310 in accordance with one or more embodiments of the disclosure. The apparatus 1300 includes a package 1330, with one or more gloves 1310 disposed within the package 1330. The package 1330, along a major face, defines an aperture 1307 through which the one or more gloves 1310 may be drawn from the package 1330. The package 1330 also includes a magnetic device 1312 coupled to the package 1330. The magnetic device 1312 is to couple the package 1330 to a ferrous object, such as filing cabinet 1331. In this illustrative embodiment, the aperture 1307 is exposed and accessible by a user when the magnetic device 1312 couples the package 1330 to the ferrous object.

In one embodiment, the plurality of gloves 1310 are manufactured from a compressible material and arranged in a stacked configuration that applies a frictional force to the interior surfaces of the package 1330. These frictional forces define a force coefficient that is required to draw a glove through the aperture 1307. Experimental testing has shown that this force coefficient, in some embodiments, is decreasing as the number of gloves in the stacked configuration decreases. Embodiments of the disclosure contemplate that the magnetic device 1312, to be reliable, may require a magnetic force adhering the package 1330 to the ferrous object that is greater than the force coefficient associated with the gloves. In particular, the magnetic force may need to be greater than the force coefficient associated with the first glove.

Figure 14:
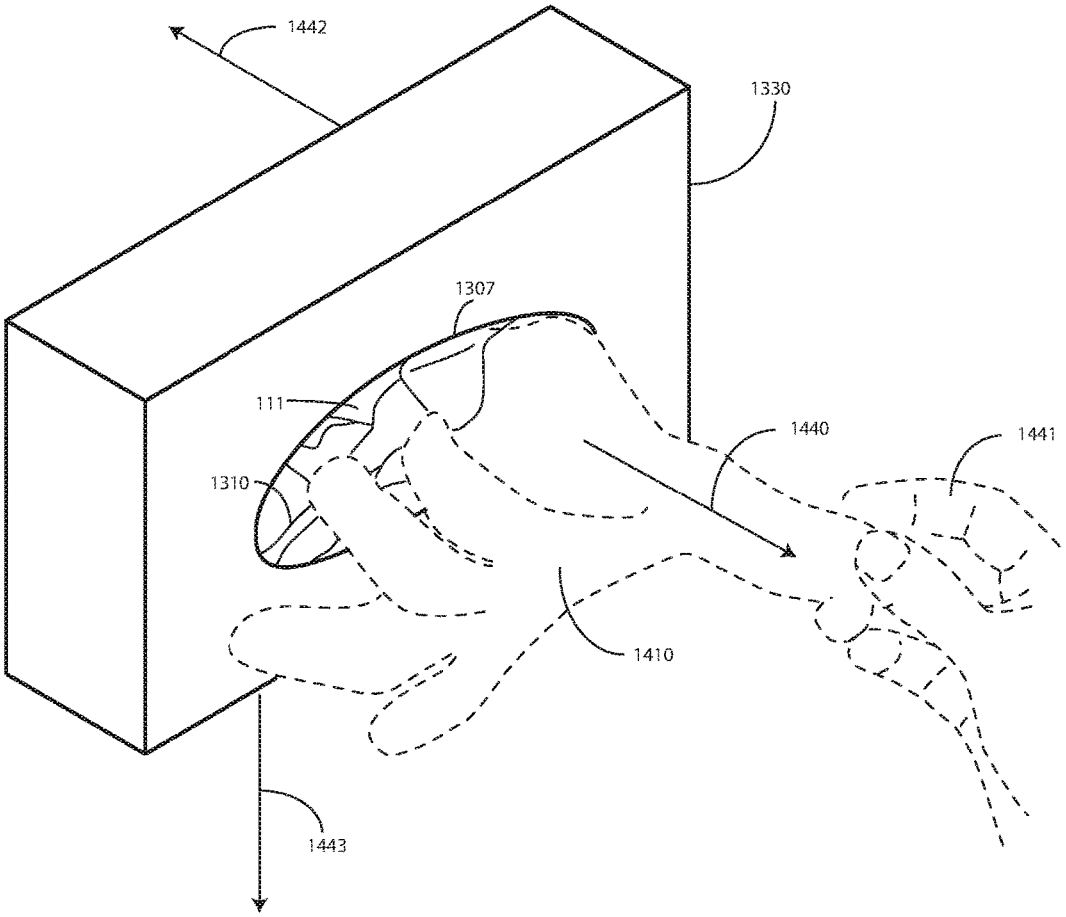
FIG. 14 illustrates one explanatory container in accordance with one or more embodiments of the disclosure in use.

Turning to FIG. 14, the force coefficient 1440 associated with the first glove 1410 is shown. A user 1441 is drawing the first glove 1410 from the package 1330. In this embodiment, the magnetic force 1442 of the magnetic device (1312) is greater than the force coefficient 1440 associated with the first glove 1410. Embodiments of the disclosure contemplate that the package 1330 and its stored gloves 1310 also have a weight 1443. Accordingly, in one embodiment the magnetic force 1442 of the magnetic device (1312) is greater than the force coefficient 1440 associated with the first glove 1410 and the weight 1443.

Moreover, if the package 1330 includes a perforated covering spanning the aperture 13107, such as barrier 111, having to pull the gloves 1310 through this perforated covering can add another force coefficient into the equation. Accordingly, in one embodiment the magnetic force 1442 of the magnetic device (1312) is greater than a sum of the force coefficient 1440 associated with the first glove 1410 plus another force coefficient required to draw the first glove 1410 through a perforation of the perforated covering. In yet another embodiment, the magnetic force 1442 of the magnetic device (1312) is greater than a sum of the force coefficient 1440 associated with the first glove 1410 plus another force coefficient required to draw the first glove 1410 through a perforation of the perforated covering plus the weight 1443. An example of such a magnetic force associated with one arrangement of the package is a coupling force of more than three pounds.

As noted above, when the first glove 1410 is drawn, the force coefficient associated therewith can be higher than, for example, the force coefficient required to draw a later glove. This is shown illustratively in FIGS. 15-16. Beginning with FIG. 15, the user 1441 is drawing the first glove 1410 from the package 1330. The force coefficient 1440 associated with this glove 1410 is the highest of any of the plurality of gloves 1310 in this embodiment due to the gloves 1310 being manufactured from a compressible material and arranged in a stacked configuration.

Figure 16:
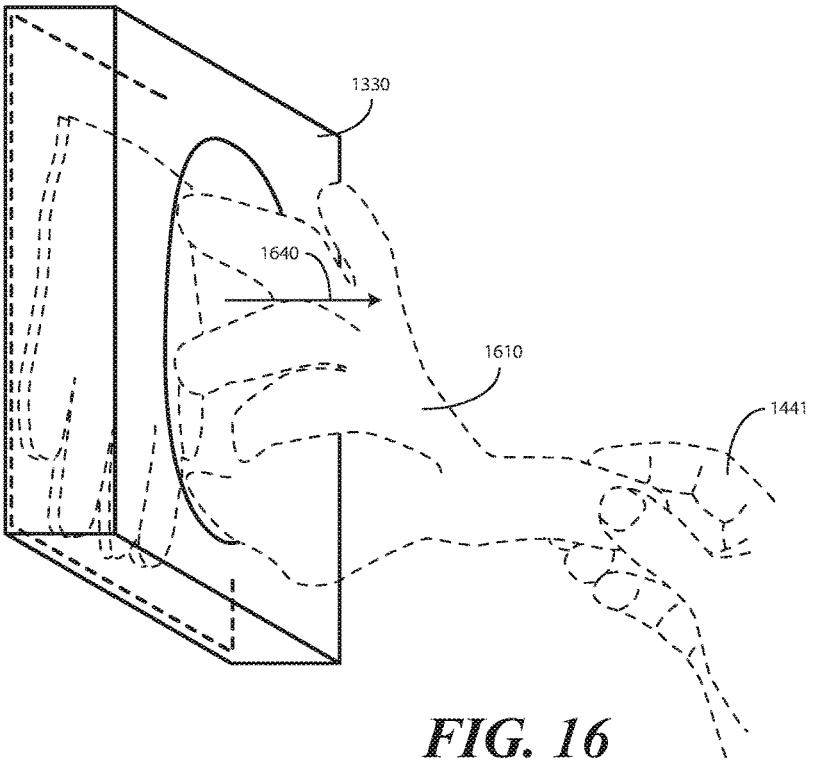
FIG. 16 one explanatory container in accordance with one or more embodiments of the disclosure in use.

By contrast, in FIG. 16, a user 1441 is drawing a subsequent glove 1610 from the package 1330. The force coefficient 1640 associated with this glove 1610 is far less than was force coefficient (1440) due to the fact that multiple gloves have been removed from the package 1330. Thus, in one embodiment, the magnetic force (1442) associated with the magnetic device (1312) is device greater than at least the force coefficient (1440) associated with a first glove (1410) of the plurality of gloves (1310).

Figure 17:
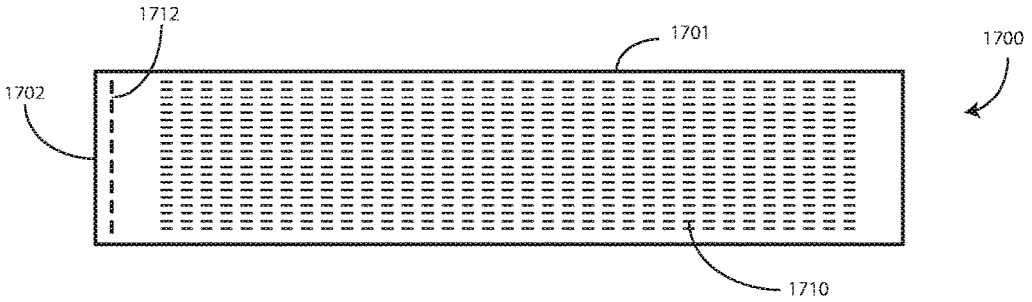
FIG. 17 illustrates a side elevation sectional view of another explanatory container in accordance with one or more embodiments of the disclosure.
Figure 18:
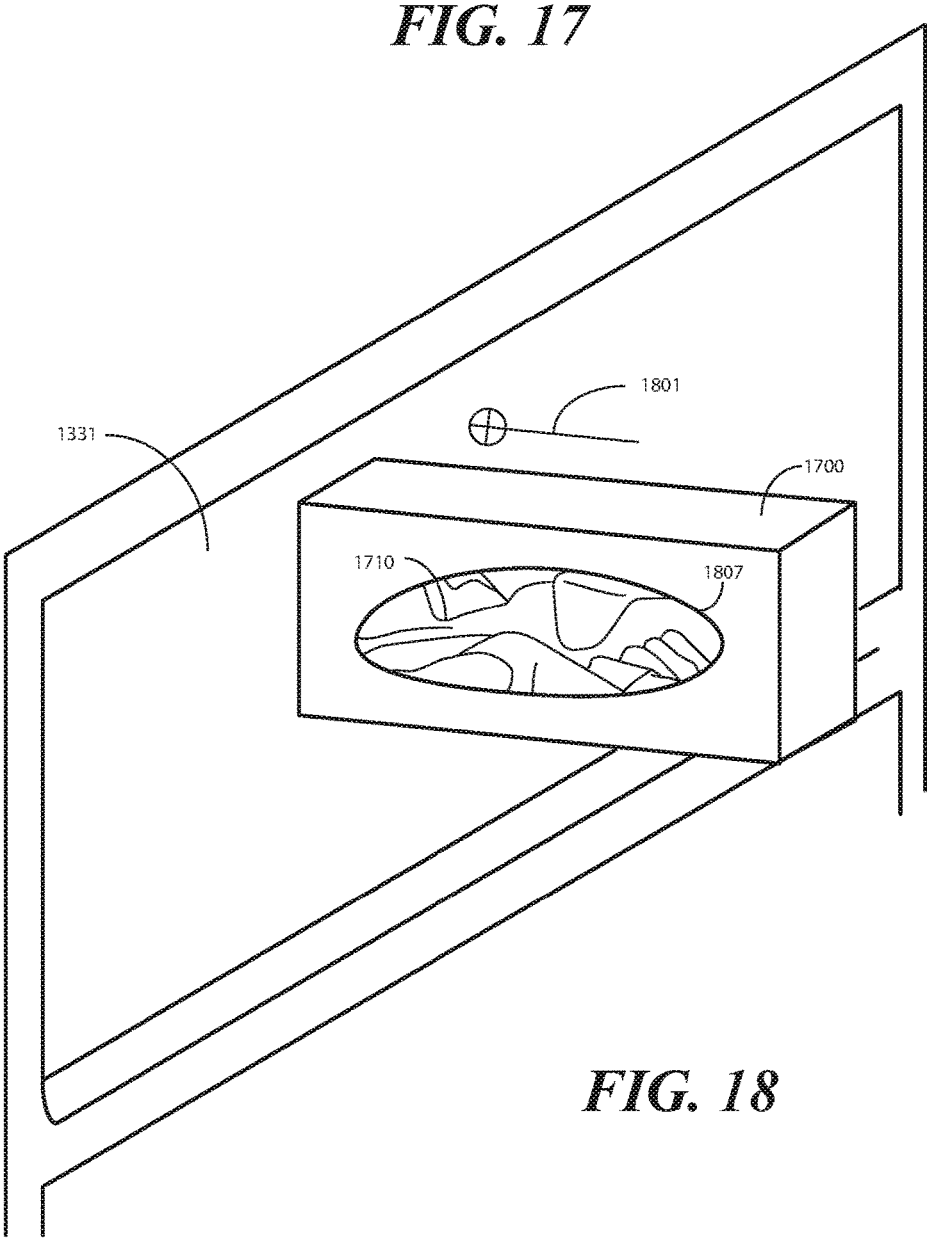
FIG. 18 illustrates another explanatory container in accordance with one or more embodiments of the disclosure in use.

FIGS. 17-18 provide an illustration of another container 1700 configured in accordance with one or more embodiments of the disclosure. Recall from above that the container (100) of FIG. 1 had a first side (101), a second side (102), and a plurality of other sides (103,104,105). The first side (101) defined a first major face of the container (100), while the second side (102) defined a second major face of the container (100). The plurality of other sides (103,104,105) separated the first major face and the second major face. The first major face defined an aperture (107), and the magnetic device (112) was disposed adjacent to the second major face.

To illustrate that instead of opposite major faces a magnetic device configured in accordance with one or more embodiments of the disclosure can be placed in other locations, FIG. 17 illustrates an alternate container 1700 configured in accordance with one or more embodiments of the disclosure. In FIG. 17, the container 1700 includes a first side 1701 and a second side 1702. The first side 1701 defines a first major face of the container 1700, while the second side 1702 defines a first minor face of the container 1700. The first side 1701 and the second side 1702 are adjacent in this embodiment. The first side 1701 defines an aperture through which one or more gloves 1710 may be drawn. A magnetic device 1712 is proximately located with the minor face, i.e., the second side 1702 of the container 1700. Accordingly, as shown in FIG. 18, the minor face can be placed adjacent to a ferrous object such as filing cabinet 1331 to permit the magnetic device 1712 to magnetically couple the container 1700 to the ferrous object.

It should be noted that with this configuration, a moment 1801 is created by pulling gloves 1710 from the container 1700. Accordingly, in this embodiment the magnetic force associated with the magnetic device 1712 can be configured to be greater than one or more of a force coefficient associated with pulling a first glove from the container 1700, another force coefficient associated with pulling gloves through a perforated covering atop the aperture 1807 if included, a weight of the container 1700 and gloves 1710, and a force counter to the moment 1801 that keeps the container from being dislodged from the ferrous object during the glove withdrawal process.

While FIGS. 1-4 and 17 illustrate a few examples of where the magnetic device may be located, others will be obvious to those of ordinary skill in the art having the benefit of this disclosure.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims.

What is claimed is:

1. A container, comprising:

a first side defining an aperture;

a second side; and a plurality of other sides;

the first side, the second side, the plurality of other sides defining an interior volume of the container;

a plurality of gloves disposed within the interior volume such that one or more gloves may be drawn from the container through the aperture; and a magnetic device disposed within the interior volume and proximately located with the second side;

wherein when the second side is proximately located with a ferrous object the magnetic device magnetically couples the container to the ferrous object;

the first side defining a first major face of the container, the second side defining a second major face of the container, and the plurality of other sides defining minor faces of the container disposed between the first major face and the second major face;

the magnetic device configured as a single, unitary, contiguous sheet;

the single, unitary, contiguous sheet defining another aperture.

2. The container of claim 1, the first side, the second side, and the plurality of other sides comprising single-ply cardboard.

3. The container of claim 1, the first side, the second side, and the plurality of other sides manufactured from plastic.

4. The container of claim 1, the aperture configured as one of a circle, an oval, a square, or a rectangle.

5. The container of claim 1, the magnetic device disposed adjacent to the second side.

6. The container of claim 1, the magnetic device adhesively coupled to the second side.

7. The container of claim 1, the aperture covered by a removable segment.

8. The container of claim 1, the plurality of gloves comprising a plurality of disposable gloves.

9. The container of claim 1, the plurality of gloves manufactured from a compressible material and arranged in a stacked configuration with a force coefficient to draw a glove through the aperture decreasing as a number of gloves in the stacked configuration decreases, a magnetic force of the magnetic device greater than the force coefficient associated with a first glove of the plurality of gloves.

10. The container of claim 9, further comprising a perforated covering spanning the aperture and defining another force coefficient to draw the first glove through a perforation of the perforated covering, the magnetic force greater than the force coefficient and the another force coefficient.

11. The container of claim 10, the container having associated therewith a weight, the magnetic force greater than a sum of the force coefficient, the another force coefficient, and the weight.

12. The container of claim 11, the force coefficient greater than three pounds.

13. The container of claim 1, the plurality of gloves and the interior volume sterile.

14. The container of claim 1, the plurality of gloves manufactured from one of latex or vinyl.

15. The container of claim 1, the plurality of gloves each comprising finger portions pointing in a common direction within the container.

16. The container of claim 1, the single, unitary, contiguous sheet comprising a planar, single, unitary, contiguous sheet.

17. The container of claim 1, the single, unitary, contiguous sheet manufactured from a magnetically flexible material.

18. The container of claim 1, the another aperture spanning a greater area than the aperture.

* * * * *